US010094180B2

(12) United States Patent
He

(10) Patent No.: US 10,094,180 B2
(45) Date of Patent: Oct. 9, 2018

(54) MECHANISM FOR TWISTING OFF DRILL ROD

(71) Applicant: CHTC JOVE HEAVY INDUSTRY COMPANY, Changsha, Hunan (CN)

(72) Inventor: Yanqi He, Hunan (CN)

(73) Assignee: CHTC JOVE HEAVY INDUSTRY COMPANY, Changsha, Hunan (CN)

( * ) Notice: Subject to any disclaimer, the term of this patent is extended or adjusted under 35 U.S.C. 154(b) by 202 days.

(21) Appl. No.: 15/110,242

(22) PCT Filed: May 26, 2014

(86) PCT No.: PCT/CN2014/000530
§ 371 (c)(1),
(2) Date: Jul. 7, 2016

(87) PCT Pub. No.: WO2015/106370
PCT Pub. Date: Jul. 23, 2015

(65) Prior Publication Data

US 2016/0326816 A1 Nov. 10, 2016

(30) Foreign Application Priority Data

Jan. 15, 2014 (CN) ..... 2014 1 0018095

(51) Int. Cl.
*E21B 19/16* (2006.01)

(52) U.S. Cl.
CPC ..... *E21B 19/163* (2013.01)

(58) Field of Classification Search
CPC ..... E21B 19/163; E21B 19/16; E21B 19/164; E21B 19/161; B23P 19/061
See application file for complete search history.

(56) References Cited

U.S. PATENT DOCUMENTS

2009/0205442 A1* 8/2009 Hunter ..... E21B 19/163 73/862.21
2012/0305233 A1* 12/2012 In ..... E21B 19/155 166/77.51

* cited by examiner

*Primary Examiner* — Robert Scruggs

(57) ABSTRACT

A mechanism for twisting off a drill rod includes a front clamping body (J0) and a rear clamping body (J1) both of which are installed at a fixed bracket. Each of the front clamping body (J0) and the rear clamping body (J1) includes a positioning clamping device and a clamping execution device which are respectively installed at two sides of a clamping centerline (JC) and opposite to each other. The front clamping body (J0) is installed within the first fixed bracket element (80) through a rear fixed shaft. The rear clamping body (J1) is installed within an overturn bracket (6) of the second fixed bracket element (81) through a rear fixed shaft. The positioning clamping device and the clamping execution device of both the front clamping body (J0) and the rear clamping body (J1) are asymmetric to each other.

4 Claims, 5 Drawing Sheets

MECHANISM FOR TWISTING OFF DRILL ROD

CROSS REFERENCE OF RELATED APPLICATION

This is a U.S. National Stage under 35 U.S.C. 371 of the International Application PCT/CN2014/000530, filed May 26, 2014, which claims priority under 35 U.S.C. 119(a-d) to CN 201410018095.X, filed Jan. 15, 2014.

BACKGROUND OF THE PRESENT INVENTION

Field of Invention

The present invention relates to a technical field of fully hydraulic drilling machine, and more particularly to a mechanism for twisting off a drill rod which is capable of disassembling and assembling the drill rod in the course of drilling operations.

Description of Related Arts

A mechanism for twisting off a drill rod is a key assembly of a fully hydraulic drilling machine, which is mainly adapted for screwing on and off the drill rod and is capable of clamping the drill rod in a hole to avoid slippage of the drill rod and drilling tool. The disassembly torque of the drill rod of the heavy-load drilling machine is able to reach over one hundred thousand Newton meter. Therefore, whether the performance of the mechanism for twisting off the drill rod is good will directly affect the drilling and disassembly efficiency of the drilling machine. Currently, there are two types of the mechanism for twisting off the drill rod, which is adopted by the fully hydraulic drilling machine, namely, a mechanism for twisting off a single drill rod and a mechanism for twisting off double drill rods. The mechanism for twisting off the drill rod comprises a base, an oil cylinder and a clamping jaw. The mechanism for twisting off double drill rods is adapted for automatically assembling and disassembling the drill rods, thereby the operation is simple and the labor intensity is decreased.

The conventional mechanism for twisting off the drill rod, as shown in FIGS. 7 and 8, comprises a positioning clamping oil cylinder 4 and a clamping assembly 3, wherein one end of an overturn oil cylinder 2 is hinged with a base 9, the other end thereof is hinged with a rear end of an overturn clamping body through a pin 1. The operational principle of the above mentioned conventional mechanism for screwing in the drill rod is as follows. While screwing in a drill rod, a piston rod of the clamping oil cylinder 4 within a fixed clamping body firstly stretches out to drive the clamping assembly 3 to tightly clamp a female wire end of a first drill rod (which has been drilled-in during the course of construction, and then a piston rod of the clamping oil cylinder within the overturn clamping body stretches out to drive the clamping assembly to tightly clamp a male wire end of a second drill rod (which is newly drilled in), and then a power head male wire is rotated into a female wire end of the second drill rod through a power head rotational torque, once finished, the clamping oil cylinder within the overturn clamping body is loosened, and simultaneously, the power head moves forwardly and rotates to screw the male wire end of the second drill rod into the female wire end of the first drill rod of the fixed clamping body. The operational principle of the above mentioned conventional mechanism for screwing off the drill rod is as follows. While screwing off one drill rod, the power head firstly moves backwardly to drive the male wire end of the first drill rod to the overturn clamping body, and the clamping oil cylinder of the overturn clamping body tightly clamps the male wire end of the first drill rod, the clamping oil cylinder of the fixed clamping body tightly clamps the female wire end of the second drill rod connected with the first drill rod which needs to be screwed off, and then the overturn oil cylinder stretches out, the overturn clamping body turns over upwardly and takes a central hole of the fixed clamping body as a center, the front and rear positioning rings installed on the overturn clamping body matches an intermediate hole, so as to loosen the first drill rod which is tightly clamped by the overturn clamping body, and then the clamping oil cylinder of the overturn clamping body loosens the drill rod, the power head rotates to drive the screw thread of the first drill rod to loosen. After loosening two drill rod ends, the clamping oil cylinder of the overturn clamping body tightly clamps the male wire end of the first drill rod again, the connect threads of both the female wire end of the first drill rod and the power head are screwed out by the power head rotational torque. The above operations are remotely controlled by an electronic control system for automatically disassembling the drill rod. During the above operations, the mechanism for twisting off the drill rod frequently works, needs a very high requirement for positioning while clamping the drill rod. However, in practice, due to various tubing length and resistance, in spite that the clamping assembly comprises multiple friction pieces, the drill rod which is clamped by the overturn clamping body is not concentric with the drill rod which is clamped by the fixed clamping body, so that the screw threads are severely worn while assembling and disassembling.

In prior arts, JP No. 2003-074286A discloses an equipment for clamping a drill rod. To resolve the center deviation of the drill rod while the left and right clamping bodies clamping the drill rod 5, firstly, the clamping oil cylinder 2 with large diameter drives the clamping jaw 24 to move forwardly to stop at a desired central position, and then the clamping oil cylinder 3 with small diameter drives another clamping jaw 34 to move forwardly to clamp the drill pipe 5. The above mentioned technical solution has shortcomings as follows. One clamping force of the clamping oil cylinder is big, and another clamping force thereof is small. While clamping, it is required that the clamping force of the clamping oil cylinder with large diameter should be equal to that of the clamping oil cylinder with small diameter, so that the control of the oil circuit is complicated. During working process, the left and right clamping slips are stressed unevenly, so that it is easy to eccentric again. Due to the clamping force of the clamping oil cylinder with small diameter, the nominal clamping force of the clamping equipment is limited.

In prior arts, the left and right clamping oil cylinders are symmetrically installed to the bracket relatively to the central axis of the drill pipe, as shown in FIG. 8, so that it is very easy to offset from the central line while clamping.

Based on the shortcomings of the above prior arts, after being improved, a breakout mechanism, with simple structure, not easy to eccentric, with short centering time and oil control simplification, is provided by the applicants of the present invention.

SUMMARY OF THE PRESENT INVENTION

Aiming at the problems of the above mentioned prior arts, an object of the present invention is to provide a mechanism for twisting off a drill rod, which has simple structure, is hard to generate a problem that the drill rod is not concentric, has short centering time and is capable of simplifying the control of the oil line.

The present invention is achieved by technical solutions as follows. A mechanism for twisting off a drill rod, comprises: a front clamping body and a rear clamping body which are installed at a fixed bracket, wherein each of the front clamping body and the rear clamping body comprises a positioning clamping device and a clamping execution device which are respectively installed at two sides of a clamping centerline and opposite to each other; the fixed bracket comprises a first fixed bracket element and a second fixed bracket element; the front clamping body is installed within the first fixed bracket element through a rear fixed shaft; the rear clamping body is installed within an overturn bracket of the second fixed bracket element through a rear fixed shaft; both the positioning clamping device and the clamping execution device are fixed to the fixed bracket; a rear lower end of the overturn bracket is hinged with a front end of a piston of an overturn oil cylinder; the positioning clamping device and the clamping execution device of both the front clamping body and the rear clamping body are asymmetric to each other; the positioning clamping device has an installation size of B, the clamping execution device has an installation size of A, and a relationship between the installation size B and the installation size A is expressed by a formula of B=A+b, wherein b is a clamping capacity while the clamping execution device tightly clamping the drill rod; when the positioning clamping device moves forwardly to a limit position, it is ensured that a clamping center of the positioning clamping device coincides with a center of the breakout mechanism, and at this time, a distance between a center of the rear fixed shaft of the positioning clamping device and a center of the drill rod is defined as the installation size B; when the clamping execution device extends outwardly to touch the drill rod and applies a rated clamping force so as to tightly clamp the drill rod, a distance between a center of the rear fixed shaft of the clamping execution device and a clamping center is defined as the installation size A.

Further, the positioning clamping device of each of the front clamping body and the rear clamping body comprises a positioning clamping oil cylinder and a slip fixed to a front end of a piston of the positioning clamping oil cylinder; the clamping execution device comprises a clamping execution oil cylinder and a slip fixed to a front end of a piston of the clamping execution oil cylinder.

Further, the positioning clamping device of each of the front clamping body and the rear clamping body is a linking device, which comprises a front connecting rod, a rear connecting rod and an intermediate connecting rod, wherein one end of the rear connecting rod is installed on the fixed bracket via a first hinged shaft, one end of the front connecting rod is connected with the slip via a second hinged shaft, the other end of the front connecting rod is connected with the other end of the rear connecting rod via a third hinged shaft, one end of the intermediate connecting rod is hinged with the third hinged shaft, and the other end of the intermediate connecting rod is connected with the piston of the oil cylinder.

Further, an oil line system of the positioning clamping oil cylinder and the clamping execution oil cylinder is designed as follows. An oil inlet of an oil pump is connected with an oil tank via pipelines. An oil outlet of the oil pump is connected with an inlet of a commutating valve via pipelines. An outlet of the commutating valve is connected with a first hydraulic control check valve. An outlet of the first hydraulic control check valve V3 is connected with an oil inlet of both the clamping execution oil cylinder and the positioning clamping oil cylinder in parallel. On an oil inputting pathway of the clamping execution oil cylinder, the first hydraulic control check valve V3 is connected with an oil inlet of the clamping execution oil cylinder through a sequence valve. An oil outlet of both the positioning clamping oil cylinder and the clamping execution oil cylinder is connected with a second hydraulic control check valve V6 in parallel. The second hydraulic control check valve V6 is connected with the commutating valve. While tightly clamping the drill rod, the commutating valve is controlled to open the first hydraulic control check valve V3, and simultaneously, the second hydraulic control check valve V6 is opened by hydraulic control oil, the oil is directly inputted into a rodless chamber of the positioning clamping oil cylinder BC so that a piston rod begins to extends outwardly, but the clamping execution oil cylinder AC is closed due to an one-way valve V5; the sequence valve V4 is unable to reach a preset pressure so that the pressure oil is not opened to have an access to the clamping execution oil cylinder AC, thus no action is done. When the oil is directly inputted into the rodless chamber of the positioning clamping oil cylinder BC so that the piston extends outwardly completely, the pressure of the oil line is increased to a preset pressure of the sequence valve V4, the sequence valve V4 is opened, the oil is directly inputted into a rodless chamber of the clamping execution oil cylinder AC so that a piston rod extends outwardly to tightly clamp the drill rod. While loosening the drill rod, the commutating valve is controlled to open the second hydraulic control check valve V6, and simultaneously, the first hydraulic control check valve V3 is opened by the hydraulic control oil, the pressure oil simultaneously enters a rod chamber of both the positioning clamping oil cylinder and the clamping execution oil cylinder, the oil cylinders at two sides are simultaneously loosened due to the open of the one-way valve V5, thereby improving an efficiency.

Beneficial effects of the present invention are as follows. The drill rod is just at a center of a center hole of a clamping device, for ensuring that while tightly clamping, the drill rod is positioned. The present invention has simple structure to retain the drill rod to be just at the center of the center hole of the clamping device, thereby simplifying the structure of the clamping device.

Figure 1:
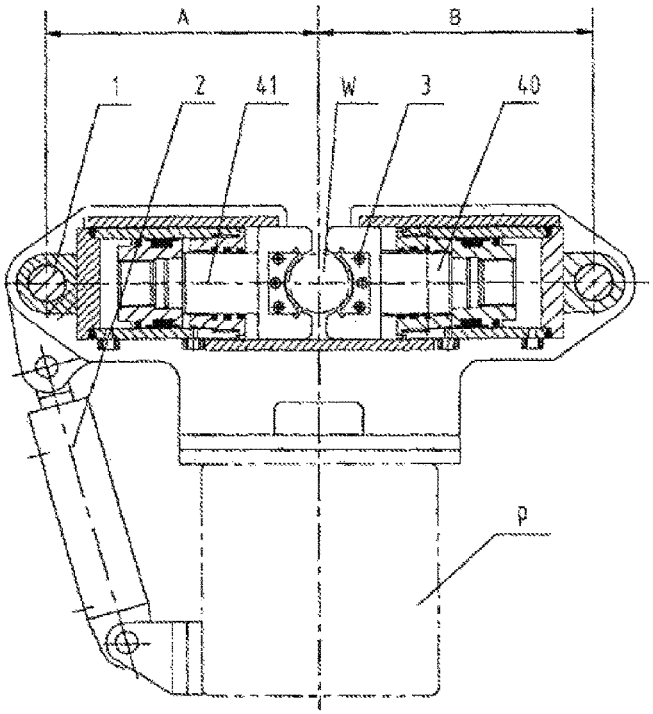
FIG. 1 is a main sectional view of a mechanism for twisting off a drill rod along C-C and shows an installation size of oil cylinders according to a first preferred embodiment of the present invention.

In the drawings, references are as follows. 1: pin; 2: overturn oil cylinder and pin; 3: slip; 40: positioning clamping oil cylinder; 41: clamping execution oil cylinder; 5: front positioning ring; 6: overturn bracket; 7: rear positioning ring; 80: first fixed bracket element; 81: second fixed bracket element; 9: base of overturn oil cylinder; A: installation size of clamping execution device; B: installation size of positioning clamping device; 10: rear connecting rod; 11: first hinged shaft; 12: front connecting rod; 13: second hinged shaft; 14: third hinged shaft; 15: intermediate connecting rod; 16: piston of oil cylinder; P: oil pump; V1: overflow valve; V2: commutating valve; V3: first hydraulic control check valve; V4: sequence valve; V5: one-way valve; V6: second hydraulic control check valve; AC: positioning clamping oil cylinder; BC: clamping execution oil cylinder; J0: front clamping body; J1: rear clamping body; JC: clamping centerline.

DETAILED DESCRIPTION OF THE PREFERRED EMBODIMENT

The present invention is explained by embodiments as follows, which is not intended to limit the protective scope of the present invention.

Embodiment 1

Figure 2:
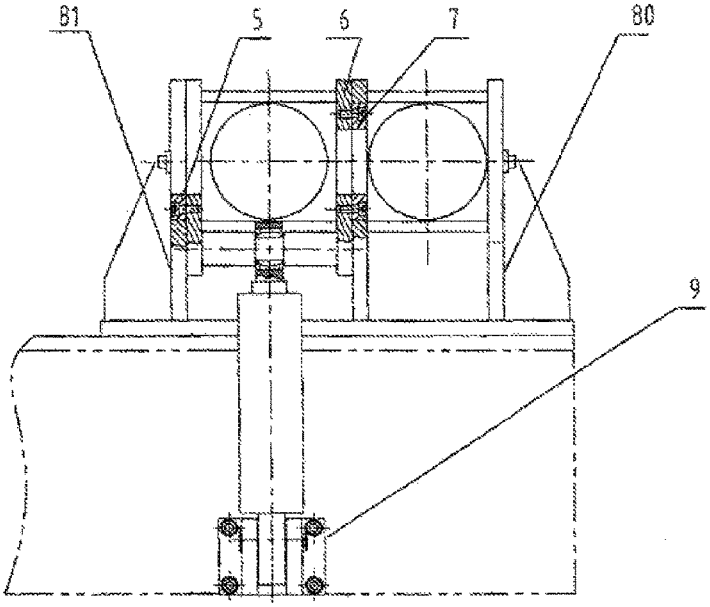
FIG. 2 is a lateral view of the mechanism for twisting off the drill rod according to the above first preferred embodiment of the present invention.
Figure 3:
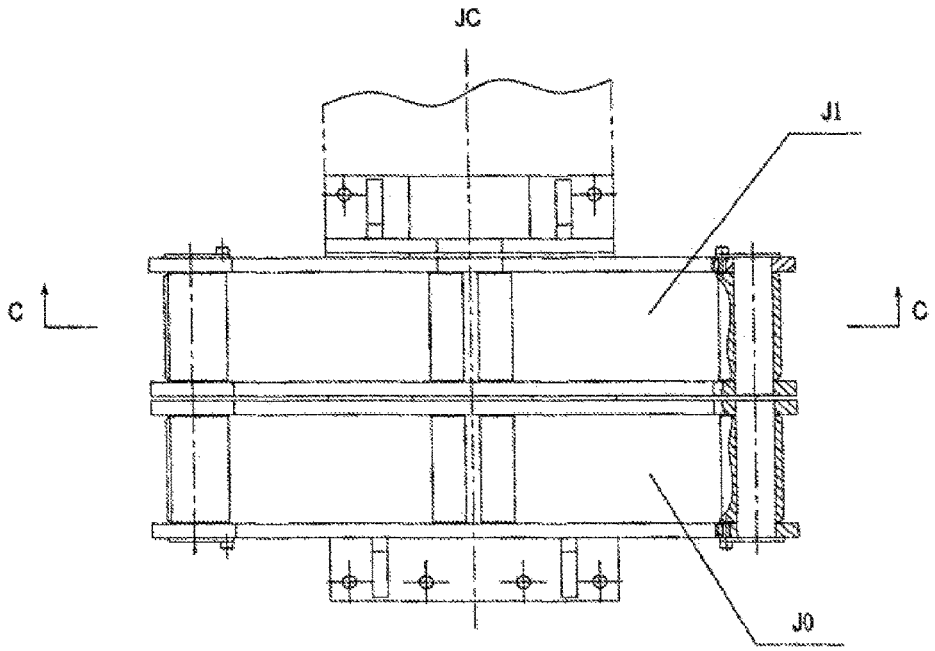
FIG. 3 is a top view of the mechanism for twisting off the drill rod according to the above first preferred embodiment of the present invention.

Referring to FIGS. 1 to 3, a mechanism for twisting off a drill rod of a drilling machine according to a first preferred embodiment of the present invention is illustrated, comprising a front clamping body J0, a rear clamping body J1, a fixed bracket 8 and an overturn bracket 6. While twisting off the drill rod, the front clamping body J0 clamps a front drill rod at two ends of a drill rod joint, the rear clamping body J1 clamps a rear drill rod at two ends of the drill rod joint, the front clamping body is fixed, the rear clamping body swings a certain angle around a central line of the drill rod, so as to loosen or tighten screw threads. The mechanism has a function for automatically twisting off the drill rod. Therefore, in the drilling machine adopts the above mentioned mechanism comprising double clamping bodies, no hydraulic cartridge is provided, which greatly simplifies the structure and improves the reliability of the drilling machine.

In the above mentioned mechanism for twisting off the drill rod, the oil cylinder of the front clamping body and the oil cylinder of the rear clamping body which are with the installation size B and located at one side of the center line of the girder P are adapted for determining the clamping center, thereby being defined as the positioning clamping device. However, the oil cylinder of the front clamping body and the oil cylinder of the rear clamping body which are with the installation size A opposite to the positioning clamping device are adapted for after determining the clamping center, clamping the drill pipe together with the positioning clamping device, thereby being defined as the clamping execution device.

The connection relationships among all elements are as follows. The fixed bracket 8, which comprises a first fixed bracket element 80 and a second fixed bracket element 81, is fixed above a girder P of the drilling machine. The front clamping body J0 is installed within the first fixed bracket element 80 through a rear fixed shaft. The rear clamping body J1 is installed within the overturn bracket 6 of the second fixed bracket element 81 through a rear fixed shaft. The front clamping body J0 comprises a positioning clamping oil cylinder 40 and a slip 3 connected with a piston rod of the positioning clamping oil cylinder, and further comprises a clamping execution oil cylinder 41 and a slip 3 connected with a piston rod of the clamping execution oil cylinder which are located at another side of a clamping centerline JC for tightly clamping the drill rod at the centerline. The rear clamping body J1 comprises a positioning clamping oil cylinder 40, a slip 3 connected with a piston rod of the positioning clamping oil cylinder, and the overturn bracket 6 rotatably which is fixed within the second fixed bracket element 81 and comprises a pin 1. The positioning clamping oil cylinder 40 and the clamping execution oil cylinder 41 of the rear clamping body J1 are installed within the overturn bracket 6. A rear lower end of the overturn bracket is hinged with a piston front end of an overturn oil cylinder 2 through a pin. Another end of the overturn oil cylinder 2 is hinged with an overturn oil cylinder base 9. The overturn oil cylinder base 9 is fixed at a side of the girder P of the drilling machine, and through the overturn oil cylinder 2 and the overturn bracket 6, drives the clamping execution oil cylinder 41, the positioning clamping oil cylinder 40 and the whole drill rod to rotate around the clamping centerline JC together, thus completing a breakout operation of the drill rod.

Therefore, a clamping center of both a positioning clamping mechanism and a clamping execution mechanism is a center of the slip 3.

To ensure the drill rod is located at a center of a center hole of the clamping device while clamping, the improved clamping execution oil cylinder and the positioning clamping oil cylinder are asymmetrically designed, that is to say, that an installation size of the positioning clamping oil cylinder is defined as B. When the positioning clamping oil cylinder moves forwardly to a limit position, it is ensured that a center of the slip coincides with the centerline JC of the mechanism; at the moment, a distance between a center of the rear fixed shaft of the positioning clamping oil cylinder and the center of the slip is defined as the installation size B. The installation size B ensures that when the positioning clamping oil cylinder extends to the limit position, the center of the drill rod is just the center of the center hole of the clamping device. Accordingly, an installation size of the clamping execution oil cylinder is defined as the installation size A. When a piston of the clamping execution oil cylinder extends outwardly to touch the drill rod, a rated clamping force is further applied to tightly clamp the drill rod; at this moment, a distance between the center of the rear fixed shaft of the clamping execution oil cylinder and the center of the slip is defined as the installation size A. A relationship between the installation size B and the installation size A is expressed by a formula of $B=A+b$, wherein b is a clamping capacity after applying the rated clamping force.

Figure 4:
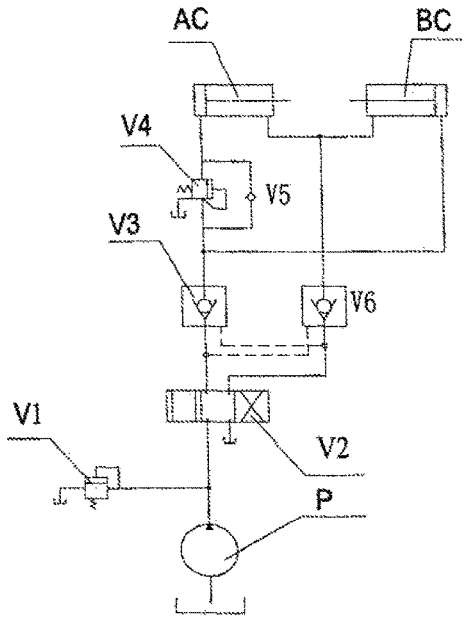
FIG. 4 shows an oil line of a clamping oil cylinder of the mechanism for twisting off the drill rod according to the above first preferred embodiment of the present invention.

To ensure the drill rod is located at the center of the center hole of the clamping device while clamping, a hydraulic pressure system of the clamping body is also correspondingly improved, as shown in FIG. 4. An oil system of the positioning clamping oil cylinder and the clamping execution oil cylinder is as follows. An oil inlet of an oil pump P is connected with an oil tank via pipelines. An oil outlet of the oil pump P is connected with an inlet of a commutating valve V2 via pipelines. An outlet of the commutating valve V2 is connected with a first hydraulic control check valve V3. An outlet of the first hydraulic control check valve V3 is connected with an oil inlet of both the clamping execution oil cylinder 41 and the positioning clamping oil cylinder 40 in parallel. On an oil inputting pathway of the clamping execution oil cylinder, the first hydraulic control check valve V3 is connected with an oil inlet of the clamping execution oil cylinder AC through both a sequence valve V4 and an one-way valve V5 connected with the sequence valve V4 in parallel. An oil outlet of both the positioning clamping oil cylinder and the clamping execution oil cylinder is connected with a second hydraulic control check valve V3 in parallel. The second hydraulic control check valve V3 is connected with the commutating valve V2. The first hydraulic control check valve V3 is connected with the oil inlet of the clamping execution oil cylinder through the sequence valve. The oil outlet of both the positioning clamping oil cylinder and the clamping execution oil cylinder is connected with a second hydraulic control check valve V6 in parallel. The second hydraulic control check valve V6 is connected with a commutating valve.

While tightly clamping the drill rod, the commutating valve is controlled to open the first hydraulic control check valve V3, and simultaneously, the second hydraulic control check valve V6 is opened by hydraulic control oil, the oil is directly inputted into a rodless chamber of the positioning clamping oil cylinder BC so that a piston rod begins to extends outwardly, but the clamping execution oil cylinder AC is closed due to the one-way valve V5; the sequence valve V4 is unable to reach a preset pressure so that the pressure oil is not opened to have an access to the clamping execution oil cylinder AC, thus no action is done. When the oil is directly inputted into the rodless chamber of the positioning clamping oil cylinder BC so that the piston extends outwardly completely, the pressure of the oil line is increased to a preset pressure of the sequence valve V4, the sequence valve V4 is opened, the oil is directly inputted into a rodless chamber of the clamping execution oil cylinder AC so that a piston rod extends outwardly to tightly clamp the drill rod. While loosening the drill rod, the commutating valve is controlled to open the second hydraulic control check valve V6, and simultaneously, the first hydraulic control check valve V3 is opened by the hydraulic control oil, the pressure oil simultaneously enters a rod chamber of both the positioning clamping oil cylinder and the clamping execution oil cylinder, the oil cylinders at two sides are simultaneously loosened due to the open of the one-way valve V5, so that an efficiency is improved, thereby ensuring that the left and right clamping oil cylinders is not dislocated while clamping.

Embodiment 2

Figure 5:
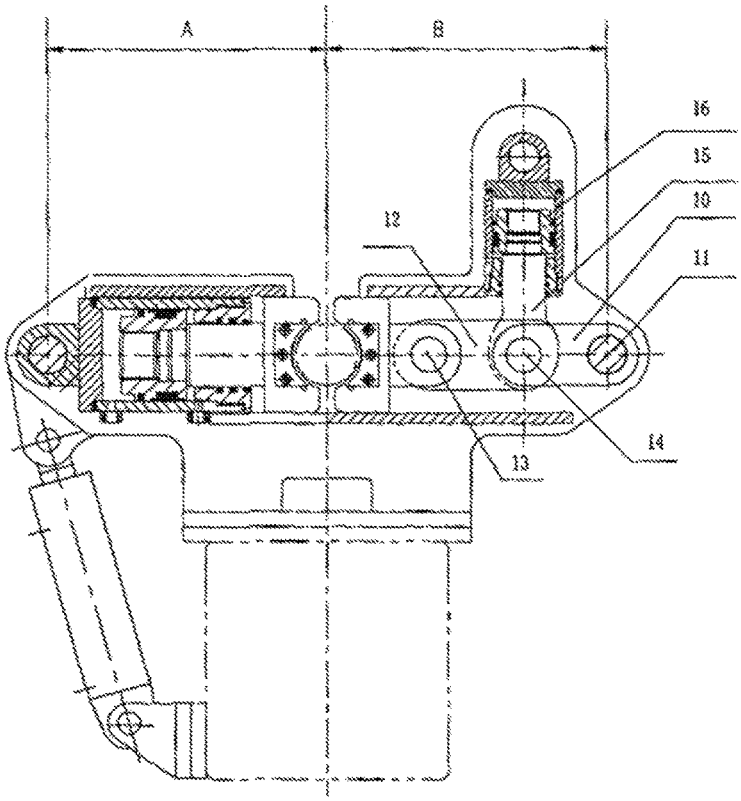
FIG. 5 is an extended state diagram of a linking device of a positioning clamping device of the mechanism for twisting off the drill rod according to a second preferred embodiment of the present invention.
Figure 6:
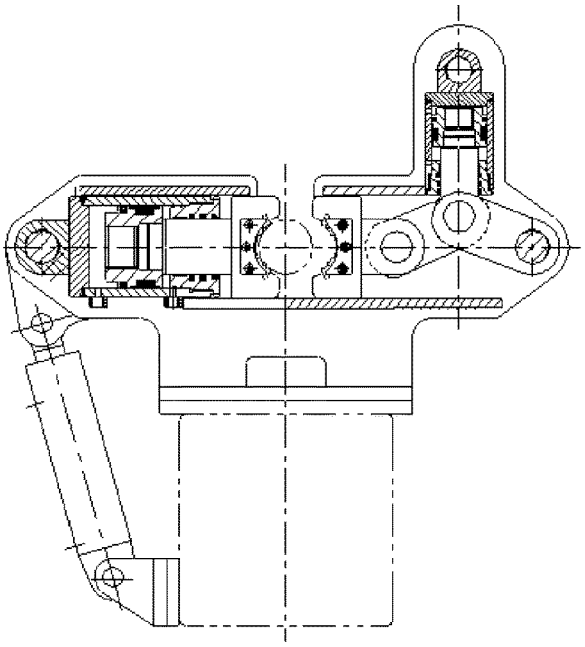
FIG. 6 is a retraction state diagram of a linking device of a positioning clamping device of the mechanism for twisting off the drill rod according to a second preferred embodiment of the present invention.
Figure 7:
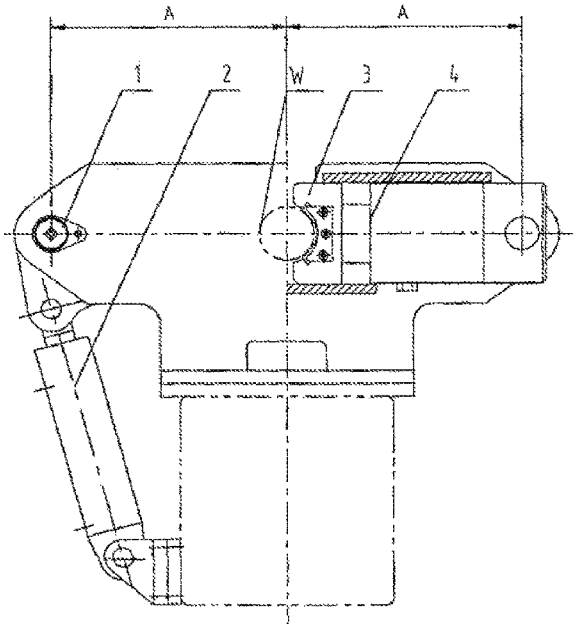
Fig. 7 (Prior Art)
FIG. 7 is a front view of a mechanism for twisting off a drill rod and shows an installation size of oil cylinders of prior arts.
Figure 8:
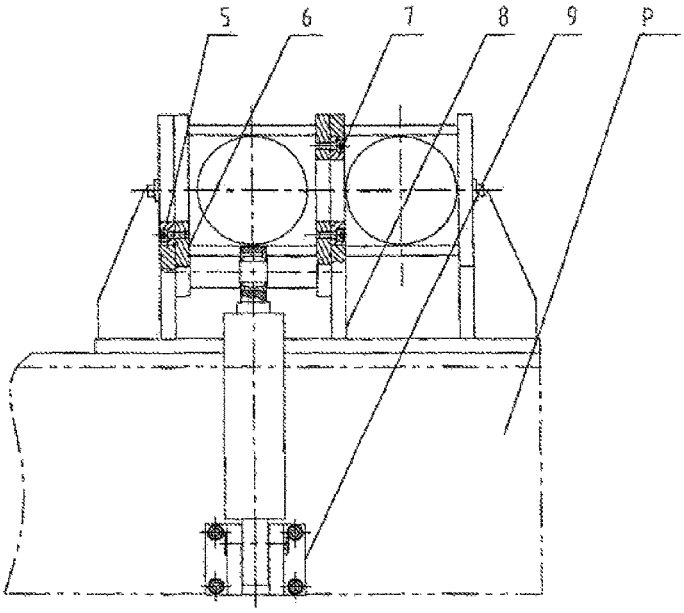
Fig. 8 (Prior Art)
FIG. 8 is a lateral view of the mechanism for twisting off the drill rod of prior arts.
Figure 9:
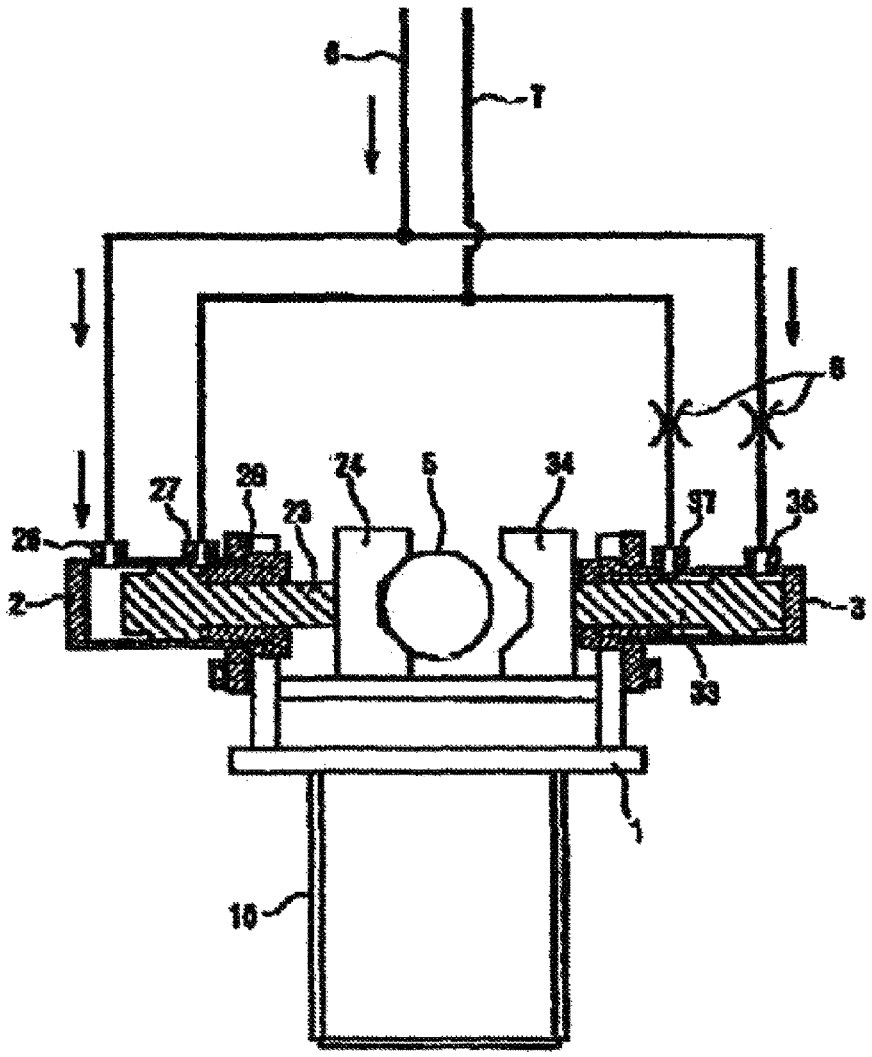
Fig. 9 (Prior Art)
FIG. 9 shows another mechanism for twisting off the drill rod of prior arts.

Referring to FIGS. 5 and 6, to ensure that while tightly clamping, the drill rod is maintained at a center of a center hole of a clamping device, the positioning clamping device is improved to be a linking device connected with a slip, one end of a rear connecting rod 10 is installed on the fixed bracket via a first hinged shaft 11, one end of a front connecting rod 12 is connected with the slip via a second hinged shaft 13, the other end of the front connecting rod 12 is connected with the other end of the rear connecting rod 10 via a third hinged shaft 14, one end of an intermediate connecting rod 15 is hinged with the third hinged shaft 14, and the other end of the intermediate connecting rod is connected with a piston 16 of the oil cylinder.

The piston 16 of the oil cylinder moves backwardly to drive the intermediate connecting rod 15 to move upwardly, and simultaneously to pull upwardly the third hinged shaft 14, the front connecting rod 12 drives the slip to move backwardly to loosen the drill pipe, as shown in FIG. 6; and however, the piston 16 of the oil cylinder moves downwardly to drive the intermediate connecting rod 15 to move downwardly, so as to press downwardly the third hinged shaft 14 till two connecting rods are located in line, as shown in FIG. 5, and at this time, the positioning clamping device is at the limit position, a center of the slip is just at the clamping centerline JC of the clamping device, if the drill pipe is clamped within the slip, it is able to be ensure that the center of the drill rod just coincides with the clamping centerline JC of the clamping device.

Similarly, in the second embodiment, the clamping execution device and the positioning clamping device are asymmetrically designed, that is to say, that the installation size of the positioning clamping device is defined as B. When the positioning clamping device moves forwardly to the limit position, it is ensured that the center of the slip coincides with the clamping centerline JC of the breakout mechanism; at the moment, the distance between the center of the rear fixed shaft (in the second embodiment, the rear fixed shaft is the first hinged shaft 11) of the positioning clamping device and the center of the slip is defined as the installation size B. The installation size B ensures that when the positioning clamping device extends to the limit position, the center of the drill rod just coincides with the clamping centerline JC of the mechanism for twisting off the drill rod. Accordingly, the installation size of the clamping execution device is defined as A. When the clamping execution device extends to touch the drill rod, the rated clamping force is further applied to tightly clamp the drill rod; at this moment, the distance between the center of the rear fixed shaft (which is embodied as the pin 1 in the second embodiment) of the clamping execution device and the center of the slip is defined as the installation size A. The relationship between the installation size B and the installation size A is expressed by the formula of B=A+b, wherein b is the clamping capacity after applying the rated clamping force.

In the present invention, the clamping device is asymmetrically designed, the oil line system of the hydraulic oil cylinder is improved, or the linking system is adopted, so as to position the installation size B, thus it is accomplished that the center of the drill rod coincides with clamping centerline JC, to ensure the center positioning of the drill rod while clamping. Therefore, the mechanism for twisting off the drill rod is able to accomplish the center positioning and simplify the structure.

What is claimed is:

1. A mechanism for twisting off a drill rod, comprising: a front clamping body (J0) and a rear clamping body (J1) which are installed at a fixed bracket, wherein each of the front clamping body and the rear clamping body comprises a positioning clamping device and a clamping execution device which are respectively installed at two sides of a clamping centerline (JC) and opposite to each other; the fixed bracket comprises a first fixed bracket element (80) and a second fixed bracket element (81); the front clamping body is installed within the first fixed bracket element (80) through a rear fixed shaft; the rear clamping body is installed within an overturn bracket (6) of the second fixed bracket element (81) through a rear fixed shaft; a rear lower end of the overturn bracket is hinged with a front end of a piston of an overturn oil cylinder (2), wherein the positioning clamping device and the clamping execution device of both the front clamping body and the rear clamping body are asymmetric to each other; the positioning clamping device has an installation size of B, the clamping execution device has an installation size of A, and a relationship between the installation size B and the installation size A is expressed by a formula of B=A+b, wherein b is a clamping capacity while the clamping execution device tightly clamping the drill rod; when the positioning clamping device moves forwardly to a limit position, it is ensured that a clamping center of the positioning clamping device coincides with a center of the breakout mechanism, and at this time, a distance between a center of the rear fixed shaft of the positioning clamping device and a center of the drill rod is defined as the installation size B; when the clamping execution device extends outwardly to touch the drill rod and applies a rated clamping force so as to tightly clamp the drill rod, a distance between a center of the rear fixed shaft of the clamping execution device and a clamping center is defined as the installation size A.

2. The mechanism for twisting off the drill rod, as recited in claim 1, wherein the positioning clamping device of each of the front clamping body and the rear clamping body comprises a positioning clamping oil cylinder (40) and a slip (3) fixed to a front end of a piston of the positioning clamping oil cylinder; the clamping execution device comprises a clamping execution oil cylinder (41) and a slip (3) fixed to a front end of a piston of the clamping execution oil cylinder.

3. The mechanism for twisting off the drill rod, as recited in claim 1, wherein the positioning clamping device of each of the front clamping body and the rear clamping body is a linking device, which comprises a front connecting rod (12), a rear connecting rod (10) and an intermediate connecting rod (15), wherein one end of the rear connecting rod is installed on the fixed bracket via a first hinged shaft (11), one end of the front connecting rod (12) is connected with the slip (3) via a second hinged shaft (13), the other end of the front connecting rod (12) is connected with the other end of the rear connecting rod (10) via a third hinged shaft (14), one end of the intermediate connecting rod (15) is hinged with the third hinged shaft (14), and the other end of the intermediate connecting rod (15) is connected with the piston (16) of the oil cylinder.

4. The mechanism for twisting off the drill rod, as recited in claim 2, wherein an oil line system of the positioning clamping oil cylinder and the clamping execution oil cylinder is designed as follows: an oil inlet of an oil pump (P) is connected with an oil tank via pipelines; an oil outlet of the oil pump (P) is connected with an inlet of a commutating valve (V2) via pipelines; an outlet of the commutating valve (V2) is connected with a first hydraulic control check valve (V3); an outlet of the first hydraulic control check valve (V3) is connected with an oil inlet of both the clamping execution oil cylinder (41) and the positioning clamping oil cylinder (40) in parallel; on an oil inputting pathway of the clamping execution oil cylinder, the first hydraulic control check valve (V3) is connected with an oil inlet of the clamping execution oil cylinder (AC) through a sequence valve (V4) and an one-way valve (V5) connected with the sequence valve (V4) in parallel; an oil outlet of both the positioning clamping oil cylinder and the clamping execution oil cylinder is connected with a second hydraulic control check valve (V6) in parallel; the second hydraulic control check valve (V6) is connected with the commutating valve (V2).

* * * * *